US005974604A

United States Patent [19]

Barnea

[11] Patent Number: 5,974,604

[45] Date of Patent: Nov. 2, 1999

[54] HEIGHT ADJUSTMENT MECHANISM

[76] Inventor: Eyal Barnea, 3 Baylor Cir., White Plains, N.Y. 10605

[21] Appl. No.: 09/056,432

[22] Filed: Apr. 7, 1998

[51] Int. Cl.[6] ..... A47K 3/22; A47K 3/20

[52] U.S. Cl. ..... 4/615; 4/570; 4/567

[58] Field of Search ..... 4/567, 570, 615, 4/255.04, 255.06; 606/170; 128/207.15

[56] References Cited

U.S. PATENT DOCUMENTS

| | | | |
|---|---|---|---|
| D. 341,007 | 11/1993 | Haug et al. | D23/223 |
| 3,504,676 | 4/1970 | Lomholt | 128/207.15 |
| 4,174,822 | 11/1979 | Larsson | 248/75 |
| 4,360,159 | 11/1982 | Haynes | 239/282 |
| 5,561,869 | 10/1996 | Sarel | 4/606 |

*Primary Examiner*—Henry J. Recla
*Assistant Examiner*—Tuan Nguyen
*Attorney, Agent, or Firm*—Peter Loffler

[57] ABSTRACT

A height adjustment mechanism for adjusting the height of a shower head by the use of the water pressure within the shower system is comprised of an inflatable bladder disposed within a channel. A first hollow tubular member extends from an opening on the bladder and has a typical shower head attached thereto while a second hollow tubular member extends from another opening on the bladder and connects to a typical water source. As water is presented into the system, the bladder inflates and engages the walls of the channel thereby holding the shower head in place. Cooperating protrusions and indentations can be used to assist in the friction engagement of the bladder with the channel walls.

13 Claims, 3 Drawing Sheets

W
12
10
14
24
26
16
18
20
22
30

HEIGHT ADJUSTMENT MECHANISM

BACKGROUND OF THE INVENTION

1. Field of the Invention

The present invention relates to a height adjustment mechanism for height adjusting a shower head within a shower stall.

2. Background of the Prior Art

Many devices have been proposed for adjusting the height of a shower head within a shower stall. Generally, these devices all rely on some form of mechanical securement mechanism to provide the required force to hold the shower head in place once the desired shower head height has been achieved. None of the prior art techniques rely on the forces of the water within the shower itself to provide the requisite forces to hold a shower head in place.

SUMMARY OF THE INVENTION

The height adjustment mechanism of the present invention relies on the force of the water passing through the shower system to provide the needed holding power to hold the shower head in place once the desired height has been achieved.

The height adjustment mechanism is comprised of a channel—which can be generally straight or generally arcuate—that is disposed within a wall of the shower stall. An inflatable bladder having a pair of openings is disposed within the channel. A first hollow tubular member protrudes through a first opening on the channel and has one end connected to one of the openings on the bladder with a shower head attached to the opposing end. A second hollow tubular member protrudes through a second opening on the channel and is connected to the other opening of the bladder and to a fluid source. The second hollow tubular member can be connected to a third hollow tubular member, pivotally or otherwise, with the third tubular member being generally resilient in order to give the tubing system the necessary play. Third tubular member resiliency is not required in an arcuate channel. The shower head is adjusted to a desired height and the shower is turned on. Once water passes through the bladder, the bladder inflates and engages the walls of the channel and thereby friction holds the shower head in place. Protrusions can be located on the bladder to assist in this friction engagement. Furthermore, corresponding indentations can be provided along the channel to receive the protrusions.

BRIEF DESCRIPTION OF THE DRAWINGS

Similar reference numerals refer to similar parts throughout the several views of the drawings.

DESCRIPTION OF THE PREFERRED EMBODIMENT

Figures 1, 2, 3:
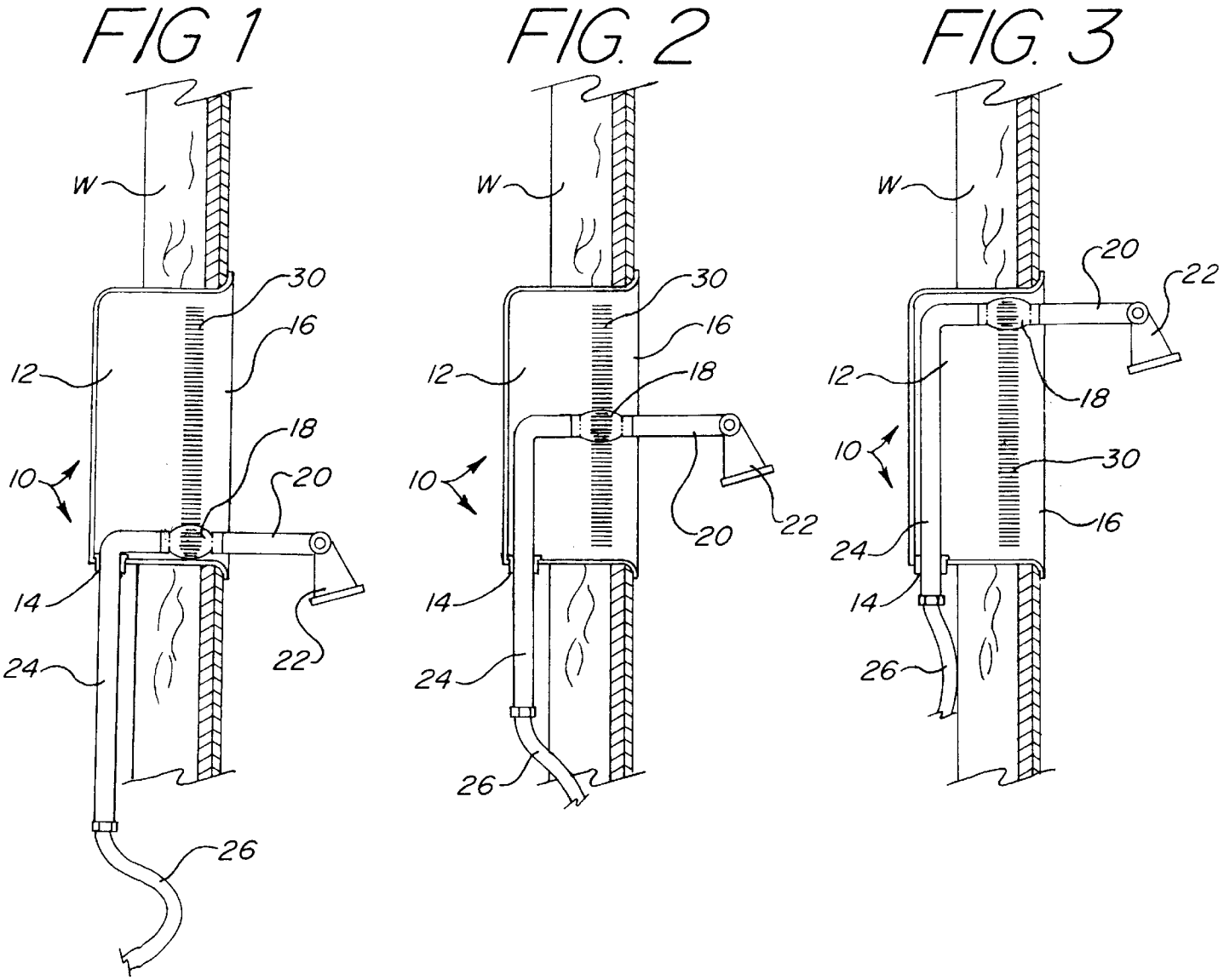
FIGS. 1–3 are side elevation views, partially sectioned, of the height adjustment mechanism of the present invention at three different heights.
Figure 4:
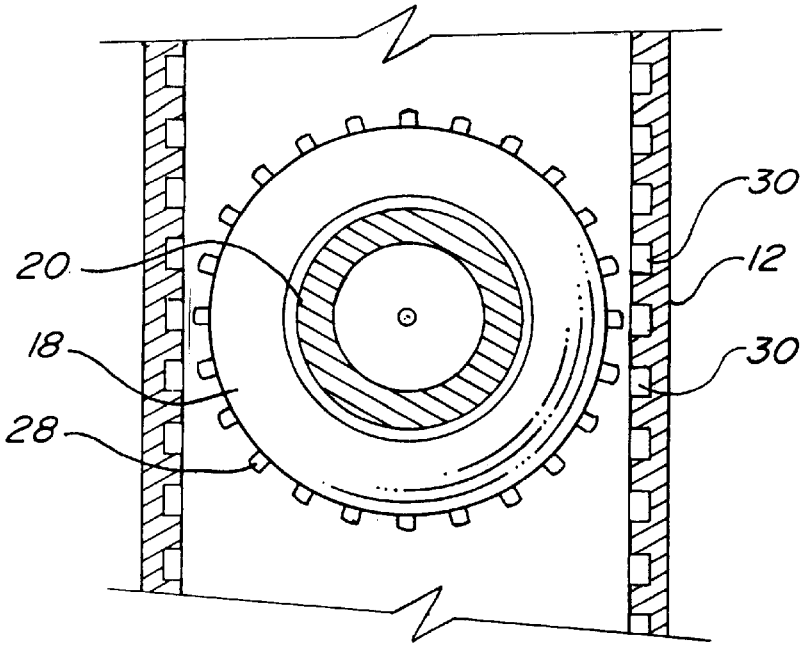
FIG. 4 is a partially sectioned view illustrating the bladder with protrusions disengaged from the channel, the channel having indentations.
Figure 5:
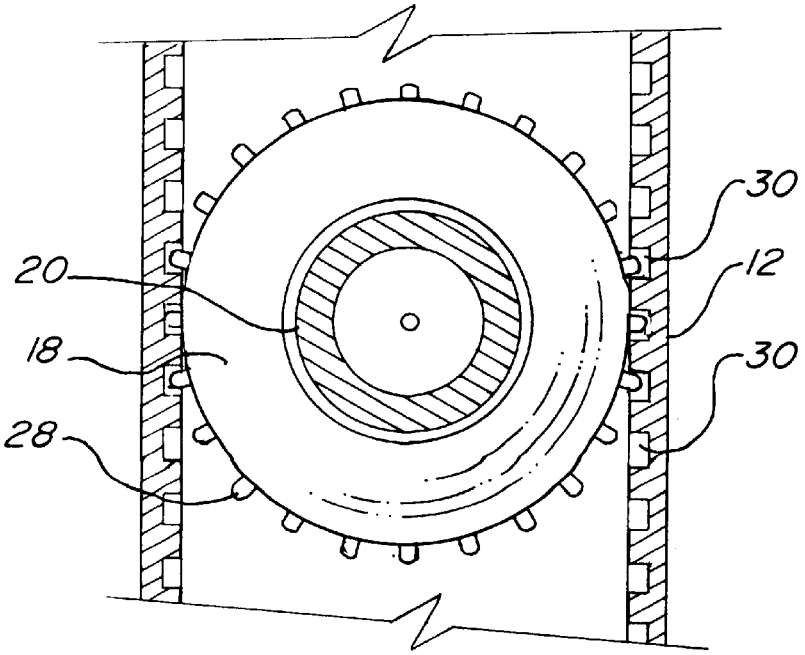
FIG. 5 is a partially sectioned view illustrating the bladder with protrusions engaged with the channel, the channel having indentations.
Figure 6:
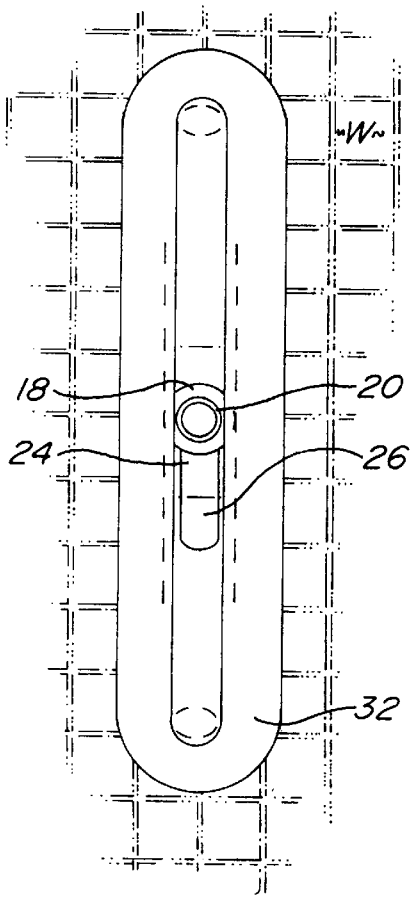
FIG. 6 is a front elevation view of the height adjustment mechanism installed within a shower stall.
Figure 7:
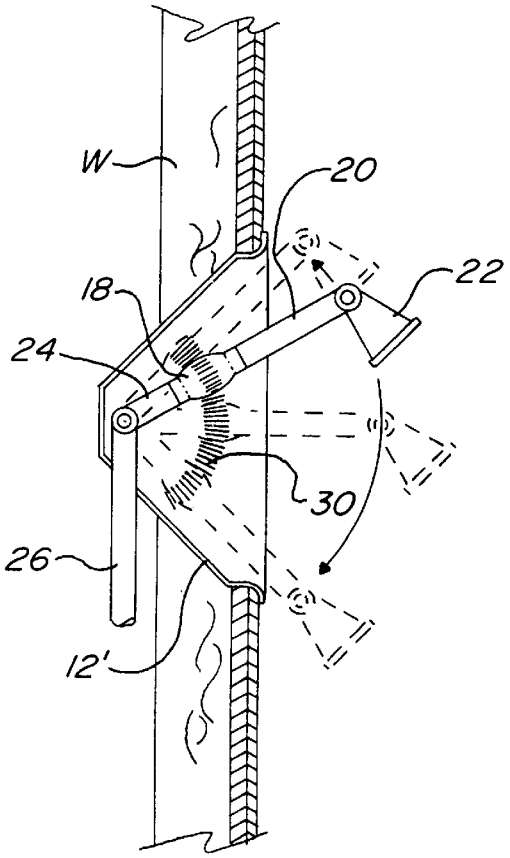
FIG. 7 is a side elevation view, partially sectioned, of the height adjustment mechanism using an arcuate channel.

Referring now to the drawings, it is seen that the height adjustment mechanism of the present invention, generally denoted by reference numeral 10, is comprised of a channel 12 that is installed within a wall W of a shower stall. The channel 12 can be generally straight, as illustrated in FIGS. 1–3, or can be generally arcuate as illustrated in FIG. 7 (labeled 12') and has a first opening 14 and a second opening 16. An inflatable bladder 18, having a third opening and a fourth opening, is disposed within the channel 12. A first hollow tubular member 20 protrudes through the first opening 14 of the channel 12 and has a first end attached to the third opening on the bladder 18 and a second end onto which a shower head 22 is attached. A second hollow tubular member 24 protrudes through the second opening 16 of the channel 12 and has a third end attached to the fourth opening of the bladder 18 and a fourth end attached to a source of water. The second tubular member 24 can be made from a generally resilient material in order to give the tubing system sufficient play during height adjustment of the shower head 22. Alternately, the fourth end of the second tubular member 24 can be attached to a third tubular member 26 with the third tubular member 26 being generally resilient and providing the requisite play in the tubing system. As seen in FIG. 7, when a generally arcuate channel 12' is used, the second tubular member 24 is pivotally attached to the third tubular member 26 and none of the tubular members need be resilient.

In order to use the height adjustment mechanism 10, the shower head 22 is positioned to the desired height and the shower is activated. As water passes through the bladder 18, the bladder 18 inflates and engages the walls of the channel 12 thereby friction holding the shower head 22 in place. The walls of the channel 12 and the bladder 18 will each be made from a material having a sufficiently high coefficient of friction in order to achieve sufficient engagement strength of the two elements under normal water pressure conditions. Furthermore, the bladder 18 can be provided with a series of protrusions 28 in order to assist in the bladder's engagement against the channel 12. The channel 12 can also be provide with a plurality of corresponding indentations 30 in order to receive the protrusions 28 of the bladder 18 upon bladder 18 inflation. The protrusions 28 and corresponding indentations 30 can be of any arbitrary shape as shown. Alternately, the protrusions 28 can be one-way ramped, with the ramped portion facing upwardly, so that the bladder 18 can be moved upwardly, but not downwardly, whenever the bladder 18 is inflated. Alternately, the indentations 30 can be ramped on their upper portion so that the bladder 18 can be moved upwardly, but not downwardly, whenever the bladder 18 is inflated. In either configuration, the water of the shower can be turned on to allow the bladder 18 to inflate before the height of the device 10 must be adjusted. The shower head 22 is moved upwardly with the bladder 18 ratcheting upwardly due to the ramped portion on either the protrusions 28 or indentations 30.

Once the water is turned off, the bladder 18 deflates and the shower head 22 will return to its lowermost position. As the water will exit from the bladder 18 in gradual fashion, the shower head 22 will descend in an orderly progression.

A cover plate 32 can be provided so as to cover the first opening 14 to prevent water from entering the channel 12. The cover plate 32 will be of any appropriate design so as to be able to appropriately extend and retract with the height adjustment of the shower head 22. The base of the channel 12 will be slanted toward the interior of the shower stall in order to return any collected water back into the stall.

While the invention has been particularly shown and described with reference to an embodiment thereof, it will be appreciated by those skilled in the art that various changes in form and detail may be made without departing from the spirit and scope of the invention.

I claim:

1. A height adjustment mechanism comprising:

a channel having an first opening and a second opening;

an inflatable bladder, having a third opening and a fourth opening, disposed within the channel;

a first hollow tubular member, having a first end attached to the third opening and a second end, extending through the first opening;

a second tubular member having a third end attached to the fourth opening and a fourth end attached to a fluid source, extending through the second opening; and a shower head attached to the second end.

2. The height adjustment mechanism as in claim 1 further comprising a third hollow tubular member having a fifth end attached to the fourth end and a sixth end.

3. The height adjustment mechanism as in claim 1 wherein the third tubular member is made from a generally resilient material.

4. The height adjustment mechanism as in claim 1 wherein the channel is generally straight.

5. The height adjustment mechanism as in claim 1 wherein the channel is generally arcuate.

6. The height adjustment mechanism as in claim 5 wherein the third tubular member is made from a generally resilient material.

7. The height adjustment mechanism as in claim 1 further comprising a third hollow tubular member having a fifth end pivotally attached to the fourth end and a sixth end.

8. The height adjustment mechanism as in claim 1 further comprising a cover plate slidably disposed within the channel proximate the first opening and attached to the first tubular member.

9. The height adjustment mechanism as in claim 1 further comprising at least one protrusion located on the bladder.

10. The height adjustment mechanism as in claim 9 wherein at least one of the at least one protrusion is ramped.

11. The height adjustment mechanism as in claim 12 further comprising a plurality of indentations disposed within the channel.

12. The height adjustment mechanism as in claim 11 wherein at least one of the at least one indentation is ramped.

13. The height adjustment means as in claim 1 the base of the channel is slanted.

* * * * *